US006931953B2

(12) United States Patent
Haruno et al.

(10) Patent No.: US 6,931,953 B2
(45) Date of Patent: Aug. 23, 2005

(54) STARTER HAVING SMALL DIAMETER FRONT HOUSING FOR INSTALLATION FROM TRANSMISSION SIDE

(75) Inventors: Kiyokazu Haruno, Anjo (JP); Masanori Ohmi, Anjo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/984,472

(22) Filed: Oct. 30, 2001

(65) Prior Publication Data

US 2002/0069710 A1 Jun. 13, 2002

(30) Foreign Application Priority Data

Dec. 8, 2000 (JP) ..... 2000-375008

(51) Int. Cl.[7] ..... F02N 11/00
(52) U.S. Cl. ..... 74/7 R; 74/7 C
(58) Field of Search ..... 74/7 E, 7 C, 7 R; 192/42, 45; 475/331, 149

(56) References Cited

U.S. PATENT DOCUMENTS 4,831,895 A * 5/1989 Tanaka et al. ..... 475/347
5,014,563 A * 5/1991 Isozumi ..... 74/7 R
5,081,875 A * 1/1992 Isozumi et al. ..... 74/7 R
5,156,057 A * 10/1992 Isozumi ..... 74/7 E
5,317,933 A * 6/1994 Rometsch ..... 74/7 R
5,533,415 A * 7/1996 Ackermann et al. ..... 74/7 E

FOREIGN PATENT DOCUMENTS

EP 0 499 955 A1 8/1992
GB 2 259 116 A 3/1993

* cited by examiner

*Primary Examiner*—William C. Joyce
(74) *Attorney, Agent, or Firm*—Oliff & Berridge, PLC

(57) ABSTRACT

In a starter, a front side bearing is provided between a one-way clutch and a pinion combined at a front end portion of a pinion tube. A housing supporting the pinion tube through the bearing has a housing small diameter portion where the inner diameter of the housing is set smaller than the outer diameter of the one-way clutch, between the bearing and a maximum advanced position of the one-way clutch. A housing front portion of the housing is formed into a cylindrical shape ahead of a attachment face which opposes to an engine side. The outer diameter of the front portion is gradually increased from the front end toward the attachment face. In this structure, the starter is installed from a transmission side without interfering the front portion of the housing with a transmission case.

16 Claims, 3 Drawing Sheets

STARTER HAVING SMALL DIAMETER FRONT HOUSING FOR INSTALLATION FROM TRANSMISSION SIDE

CROSS REFERENCE TO RELATED APPLICATION

The present application relates to and incorporates herein by reference Japanese Patent Application No. 2000-375008 filed on Dec. 8, 2000.

BACKGROUND OF THE INVENTION

The present invention relates to an overhang-type starter having a bearing between a one-way clutch and a pinion.

In recent years, due to environmental needs such as fuel economy regulation and an exhaust gas control, an intake pipe or a catalytic converter attached to an engine is enlarged in size and the number of other accessory devices are increased. This has resulted in less space around the engine. For example, when a starter 100 is installed from an engine side, it is likely to interfere with the intake pipe 110 and the catalytic converter 120 which are enlarged as shown in cross hatched portions of FIG. 4A. Therefore, as shown in FIG. 4B, it is proposed to install the starter from a transmission side 130. However, in an inboard-type starter which provides a pinion between bearings, a housing nose portion including the front side bearing interferes with an engine block or the like. Thus, it is practical to use a cantilever-type starter which provides the pinion ahead of a front side bearing. Also, since stays and the like are required to install the cantilever-type starter, a small-sized and lightweight starter is preferable rather than a large and heavy starter.

For example, in a starter disclosed in JP-U-4-104164 (EP 0499 955 A1), an output shaft is provided in a coaxially aligned manner with a rotary shaft by using a planetary speed reduction gear device for decreasing the starting motor in size. However, in this starter, an axial distance between a front side bearing and a maximum advanced position of a one-way clutch moving on an output shaft is shortened. Therefore, the outer diameter of a housing front portion between a front end of the housing supporting the front side bearing and an attachment face opposing an engine side is increased step-wise in the axial direction. Especially, in a vehicle having an automatic transmission, since the starter is mounted over a transmission case installing a hydraulic torque converter, the front portion of the housing is likely to interfere with the transmission case.

SUMMARY OF THE INVENTION

The present invention is made in view of the above problems and it is an abject to provide a starter readily installed from a transmission side.

In a starter according to the present invention, an amount of axially forward movement of a one-way clutch is restricted by a stopper portion provided on an output shaft. A housing small diameter portion where an inner diameter of a housing is smaller than an outer diameter of the one-way clutch is formed between a front side bearing and a maximum advanced position of the one-way clutch.

Therefore, a span between a front side bearing such as ball bearings and a rear side bearing provided axially behind the one-way clutch is increased so that load applied to the front side bearing can be decreased. Accordingly, a diameter of the bearing is decreased, resulting in decrease in the outer diameter of a front portion of the housing having the front side bearing.

Further, a housing front portion is formed into a cylindrical shape from the front end having the bearing to an attachment face opposing the engine side. The outer diameter of the housing front portion is gradually increased from the front end toward the attachment face. Therefore, the starter can be efficiently installed from a transmission side without interfering the front portion of the housing with a transmission case.

BRIEF DESCRIPTION OF THE DRAWINGS

Other objects, features and advantages of the present invention will become more apparent from the following detailed description made with reference to the accompanying drawings.

In the drawings.

DETAILED DESCRIPTION OF PREFERRED EMBODIMENTS

Preferred embodiments of the present invention will be described hereinafter with reference to drawings.

Figure 1:
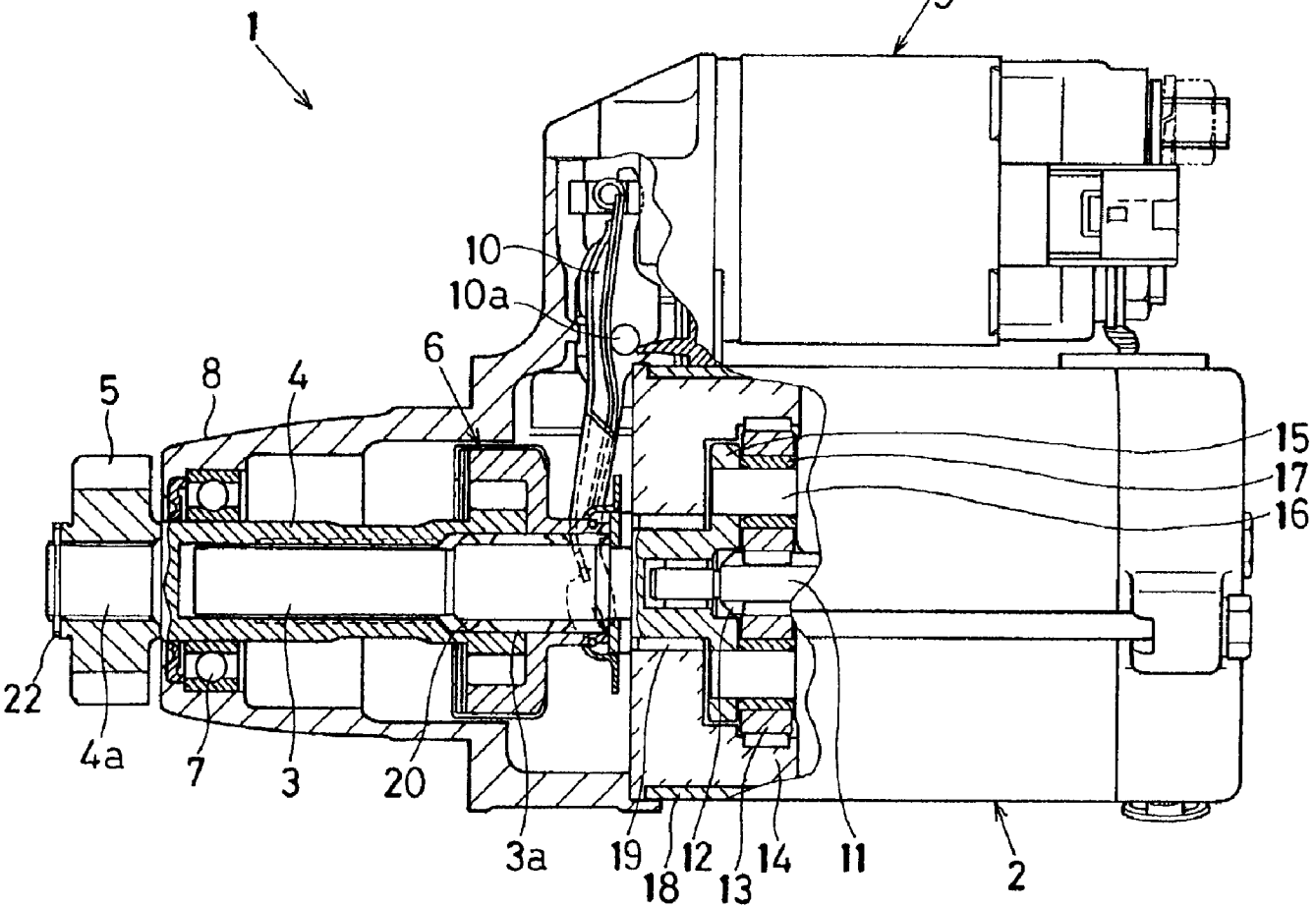
FIG. 1 is a schematic view partially including a cross-section of a starter according to a preferred embodiment of the present invention.

As shown in FIG. 1, a starter 1 of the present embodiment is an overhang-type starter. The starter 1 is constructed of a starting motor 2 for generating rotation force, a planetary speed reduction gear device (described later) for reducing a rotation speed of the starting motor 2, an output shaft 3 for receiving the rotation force of the starting motor 2 through the planetary speed reduction gear device, a pinion tube 4 fitted to the output shaft 3 to be slidable in the axial direction, a pinion 5 combined at the front end portion of the pinion tube 4, a one-way clutch 6 for transmitting the rotation force of the output shaft 3 to the pinion tube 4, a front side bearing 7 disposed between the pinion 5 and the one-way clutch 6, a housing 8 supporting the pinion tube 4 through the bearing 7, and the like.

The starting motor 2 is a well-known d.c. motor. When a key switch (not shown) is turned on and a motor contact provided in a magnet switch 9 is connected, an armature (not shown) is energized and begins to rotate.

The magnet switch 9 has a plunger (not shown) provided to be slidable in the axial direction (left-right direction in FIG. 2) and a field coil (not shown) for generating pull-in force for sliding the plunger. The motor contact is connected and disconnected with movement of the plunger. The pull-in force for moving the plunger is transmitted to the one-way clutch 6 through a lever 10.

The planetary speed reduction gear device has a sun gear 12 provided on a rotary shaft 11 of an armature, planetary gears 13 meshing with the sun gear 12, an internal gear 14 meshing with the planetary gears 13. Revolution of the planetary gears 13 is transmitted to the output shaft 3 through a planetary carrier 15.

The planetary gears 13 are rotatably supported against carrier pins 16 which are press-fitted in the carrier 15 through bearing 17. The internal gear 14 is an annulus gear to which the planetary gears 13 are inscribed. The internal gear 14 is provided in a rotation-restricted manner against a center case 18 which is, for instance, extended from a yoke of the starting motor 2 and rotatably supports the output shaft 3 through a bearing 19.

Figure 2:
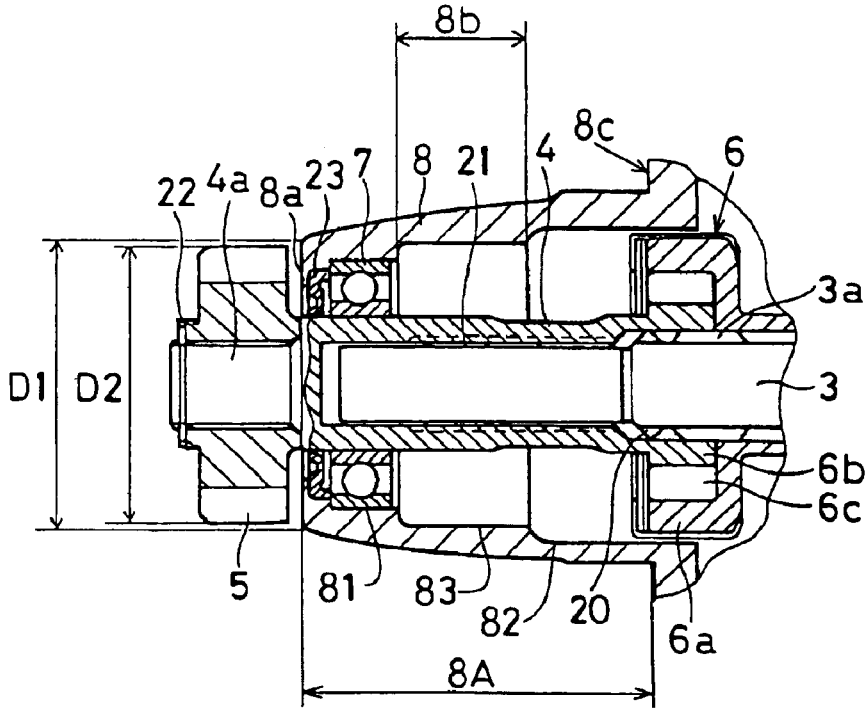
FIG. 2 is a cross-sectional view of a front portion of the starter according to the preferred embodiment.

The output shaft 3 is disposed in a coaxially aligned manner with the rotary shaft 11 of the armature, and integrates the carrier 15 at the rear end thereof. As shown in FIG. 2, the output shaft 3 has helical splines 3*a* on the outer peripheral surface thereof to engage with the one-way clutch 6, and provides stopper portions at front ends of the helical splines 3*a*, for restricting an amount of movement of the one-way clutch 6 in the axially forward direction.

The pinion tube 4 has a shaft portion 4*a* to combine with the pinion 5 at the front end thereof, and the rear side of the shaft portion 4*a* is formed into a cylindrical shape to be fitted on an outer periphery of the output shaft 3 through a metallic bearing 21 (see FIG. 2). The shaft portion 4*a* has splines on the outer peripheral surface thereof to support the pinion 5 in a rotation-restricted manner.

The pinion 5 is spline-connected to the shaft portion 4*a* which protrudes from the front end portion of the pinion tube 4 ahead of the bearing 7 in the axial direction. Further, the pinion 5 is restricted from moving in the axial direction by a detent ring 22 fitted at the tip end of the shaft portion 4*a*.

As shown in FIG. 2, the one-way clutch 6 is constructed of a clutch outer 6*a* for receiving rotation of the rotary shaft 3 through the helical splines 3*a*, a clutch inner 6*b* integrated with the cylindrical portion of the pinion tube 4, rollers 6*c* for transmitting rotation of the clutch outer 6*a* to the clutch inner 6*b*, and the like. The one-way clutch 6 transmits rotation of the output shaft 3 to the pinion tube 4 at the time of starting an engine. Further, when a rotation speed of the pinion tube 4 exceeds that of the output shaft 3 right after the engine starts, the one-way clutch 6 interrupts a motive power transmission between the output shaft 3 and the pinion tube 4 to restrict the armature from overrunning.

The housing 8 supports the pinion tube 4 to be rotatable and slidable in the axial direction through the front side bearing 7, such as ball bearings. As shown in FIG. 2, the front portion of the housing 8 has a front end wall 8*a* so as to surround the front side of the bearing 7, and a sealing member 23 is installed between the front side wall 8*a* and the bearing 7.

The housing 8 has a housing small diameter portion 8*b* where the inner diameter of the housing 8 is set smaller than the outer diameter of the one-way clutch 6, as shown in FIG. 2. The housing small diameter portion 8*b* is formed between the bearing 7 and the maximum advanced position of the one-way clutch 6 which forward movement is restricted by the stopper 20. The housing 8 has a housing front portion 8A axially ahead of an attachment face 8*c* which faces the engine side. The housing front portion 8A is formed into a generally cylindrical shape. The outer diameter of the housing front portion 8A gradually increases from the front end toward the attachment face 8*c*. Further, the outer diameter D1 of the front end of the housing front portion 8A is set substantially equal to the outer diameter D2 of the pinion 5.

As shown in FIG. 2, the housing 8 includes a bore therein. The bore is defined with three portions (cylindrical surfaces) including a first portion 81, a second portion 82 and a third portion 83. The first portion 81 has an inner diameter that is formed to hold the bearing 7 therein. The second portion 82 has an inner diameter that is sufficiently large to accommodate the one-way clutch 6. The third portion 83 is axially interposed between the first and second portions. The third portion 83 has an inner diameter that is larger than an inner diameter of the first portion 81 and is smaller than an inner diameter of the second portion 82. The third portion 83 provides the smaller diameter portion 8*b*.

Next, operation of the starter 1 is described.

After the magnet switch 9 is operated by turning on the key switch, the lever 10 pivots at a supporting point 10*a* by movement of the plunger so that the one-way clutch 6 is pushed axially forward (left side in FIG. 2) on the output shaft 3 through the lever 10. Further, the pinion tube 4 is moved axially forward on the output shaft 3 with the one-way clutch 6, and then the pinion 5 combined with the pinion tube 4 meshes with a ring gear 24 (see FIG. 3) of the engine.

On the other hand, after the motor contact is connected by the movement of the plunger, the armature in the starting motor 2 is energized and begins to rotate. The rotation speed of the armature is reduced by the gear reduction device, and then, the rotation is transmitted to the output shaft 3. Further, the rotation of the output shaft 3 is transmitted to the pinion tube 4 through the one-way clutch 6. Then, the pinion 5 meshes with and rotates the ring gear 24 to crank the engine.

After the engine starts, the rotation speed of the pinion 5 meshing with the ring gear 24 exceeds that of the output shaft 3. At this time, the motive power transmission between the pinion tube 4 and the output shaft 3 is interrupted by the one-way clutch 6 to prevent the armature from overrunning. Then, when the key switch is turned off, the plunger in the magnet switch 9 returns to the stationary position so that the one-way clutch 6 is pulled axially backward on the output shaft 3 through the lever 10. Thus, the pinion tube 4 integrally moves axially backward on the output shaft 3 with the one-way clutch 6 so that the pinion 5 is disengaged from the ring gear 24 and returns to the stationary position shown in FIG. 1. Further, the motor contact is disconnected in accordance with returning of the plunger so that the electric current to the armature is shut off to stop armature rotation.

(Effects of the Present Embodiment)

In the starter 1 of the present embodiment, the housing small diameter portion 8*b* is provided between the maximum advanced position of the one-way clutch 6 and the front side bearing 7, as shown in FIG. 2. Accordingly, the housing front portion 8A of the housing 8 can be formed into the cylindrical shape and the outer diameter of the housing front portion 8A is gradually increased from the front end thereof toward the attachment face 8*c* without increasing step-wise in the axial direction. In addition, since the housing small portion 8*b* is provided, a span between the front side bearing 7 and the rear side bearing 19 can be increased. As a result, load applied to the bearing 7 can be decreased so that the bearing 7 is decreased in diameter, resulting in further decrease in the outer diameter of the housing front portion 8A.

Figure 3:
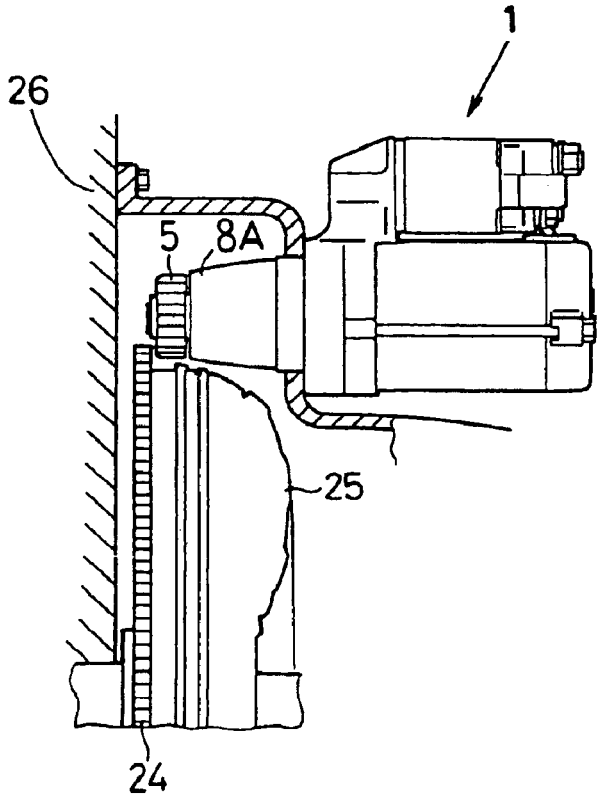
FIG. 3 illustrates an installation state of the starter when the starter is installed from a transmission side.
Figure 4A:
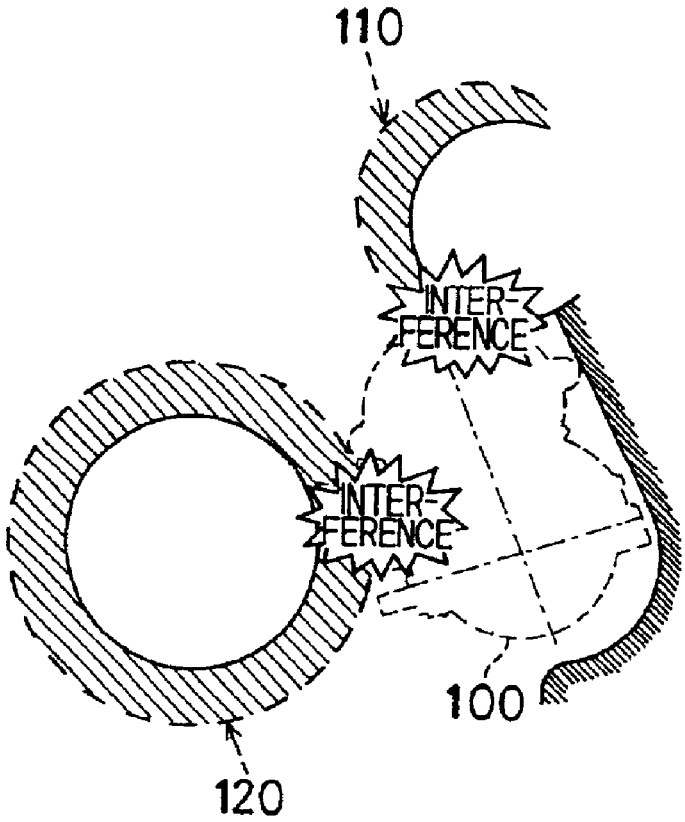
FIG. 4A RELATED ART
FIG. 4A illustrates an installation position of a starter which is installed from an engine side and FIG. 4B is a view for explaining an installation of the starter from a transmission side.
Figure 4B:
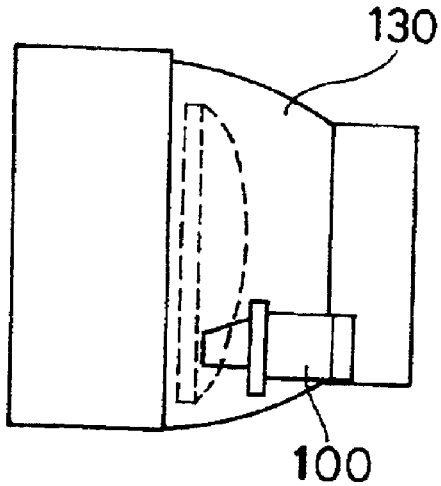
FIG. 4B RELATED ART

As shown in FIG. 3, for instance, even when the starter 1 is installed from the transmission side, the pinion 5 can be meshed with the ring gear 24 without interfering the housing front portion 8A with a transmission case 25. Specially, the starting motor 2 is decreased in size by using the planetary speed reduction gear device. Further, the starter 1 is small-sized and light-weighted by providing the output shaft 3 in the coaxially aligned manner with the rotary shaft 11 of the armature. Accordingly, installation of the starter 1 from the transmission side is improved in accordance with small-sizing of the housing front portion 8A.

(Modified Embodiment)

In the starter 1 of the above embodiment, a buffer maybe provided in order to absorb an excessive torque applied to the planetary speed reduction gear device. As a buffer, it is widely used for the starter having the planetary speed reduction gear, such as a buffer which slides a rotary disc to absorb the excessive torque or a buffer using elastic deformation of elastic members (e.g. rubber) to absorb the excessive torque. The maximum load applied to the bearing 7 can be decreased by using the above buffers. Therefore, it is possible to decrease the bearing 7 in diameter, and as a result, the housing front portion 8A of the housing 8 can be decreased in diameter.

The present invention should not be limited to the disclosed embodiments, but may be implemented in other ways without departing from the spirit of the invention.

What is claimed is:

1. A starter, comprising:

a starting motor for generating rotation force;

an output shaft for receiving rotation of the starting motor and having helical splines;

a pinion tube fitted to the output shaft to be slidable in an axial direction;

a pinion provided at a front end of the pinion tube;

a one-way clutch combined with the output shaft through the helical splines for transmitting rotation of the output shaft to the pinion tube, the one-way clutch being slidable on the output shaft with the pinion tube;

a stopper portion for defining a maximum advanced position of the one-way clutch in the axial direction;

a front side bearing provided ahead of the one-way clutch in the axial direction; and a housing supporting the pinion tube through the bearing at front end, wherein:

the housing forms an attachment face, which faces an engine side and is fixed to the engine when installed, and defines an inner bore having a first cylindrical portion for holding the bearing therein, a second cylindrical portion having an inner diameter larger than an outer diameter of the one-way clutch so that the one-way clutch is accommodated therein even in a maximum advanced position of the one-way clutch, and a third cylindrical portion axially interposed between the first cylindrical portion and the second cylindrical portion, the third cylindrical portion forms a housing small diameter portion having an inner diameter that is smaller than an outer diameter of the one-way clutch and larger than an inner diameter of the first cylindrical portion, a dimension from a front end of the housing to the attachment face with respect to the axial direction is substantially larger than an outer diameter of the pinion, the first to third cylindrical portions are located axially forward of the attachment face, the one-way clutch is disposed to be slidable in the second cylindrical portion such that an outer peripheral surface of the one-way clutch is adjacent to inner peripheral surface of the second cylindrical portion, a diameter of the inner bore is decreased stepwise toward a front position of the housing, the first cylindrical portion and the third cylindrical portion form a first step therebetween, the third cylindrical portion and the second cylindrical portion form a second step therebetween, and a rear face of the bearing is located axially forward of the first step of the third cylindrical portion.

2. The starter as in claim 1, wherein the housing has a housing front portion between the front end and the attachment face, and the housing front portion is formed into a cylindrical shape in the axial direction, and an outer diameter of the housing front portion is gradually increased from the front end to the attachment face.

3. The starter as in claim 2, wherein the housing small diameter portion is included in the housing front portion.

4. The starter as in claim 2, wherein the third cylindrical portion has an axial dimension larger than an axial dimension of the pinion.

5. The starter as in claim 1, wherein the pinion is combined with the front end of the pinion tub which is protruded axially forward ahead of the front side bearing, and an outer diameter of the front end of the housing is substantially equal to the outer diameter of the pinion.

6. The starter as in claim 1, wherein the stopper portion is provided on the output shaft.

7. The starter as in claim 1, further comprising:

a planetary speed reduction gear device that includes a carrier and planetary gears supported by the carrier, wherein the rotation of the starting motor is reduced in speed by revolution of the planetary gears and transmitted to the output shaft through the carrier.

8. The starter as in claim 1, wherein the inner diameter of the second cylindrical portion is gradually decreased at the second step to define an edge on a rear side end of the third cylindrical portion, and the inner diameter of the third cylindrical portion is gradually decreased at the first step to define an edge on a rear side end of the first cylindrical portion.

9. The starter as in claim 1, wherein a front end of the third cylindrical portion connecting to the first cylindrical portion forms a round corner with a predetermined curvature on an axially rear side of the first step and a front end of the second cylindrical portion connecting to the third cylindrical portion forms a round corner with a predetermined curvature, and a rear face of the bearing is located axially forward of the round corner of the third cylindrical portion.

10. The starter as in claim 1, wherein front face of the one-way clutch is located forward of the attachment face with respect to the axial direction.

11. The starter as in claim 1, wherein the pinion is located axially forward of the front end of the housing, a rear face of the pinion face a front-most face of the housing, and an outer diameter of the front end of the housing is substantially equal to the outer diameter of the pinion and increases toward the attachment face.

12. The starter as in claim 1, wherein the third cylindrical portion has an axial dimension larger than an axial dimension of the pinion.

13. A starter, comprising:

an output shaft rotatably supported and having helical spline on an outer periphery;

a pinion tube slidable in an axial direction with respect to output shaft;

a pinion provided on a front end of the pinion tube;

a one-way clutch connecting with the output shaft through the helical splines, the one-way clutch slidable on the output shaft in the axial direction and transmitting rotation of the output shaft to the pinion tube;

a stopper portion provided on the output shaft to define a maximum advanced position of the one-way clutch in the axial direction;

a bearing supporting the pinion shaft ahead of the one-way clutch in the axial direction; and a housing including an attachment face which is attached to an engine side when in use, and a housing front portion formed in front of the attachment face, wherein:

the housing front portion defines an inner bore having a first cylindrical portion for enclosing the bearing at a position away from the attachment face in the axial direction, a second cylindrical portion for accommodating the one-way clutch even in the maximum advanced position to which the one-way clutch slides in the axial direction, and a third cylindrical portion axially interposed between the first cylindrical portion and the second cylindrical portion, the third cylindrical portion has an inner diameter that is smaller than an outer diameter of the one-way clutch and an axial length greater than that of the first cylindrical portion, the first and third cylindrical portions form a first step between them and the third and second cylindrical portions form a second step between them, so that an inner diameter of the inner bore decreases stepwise toward a housing front position, a rear face of the bearing is located axially forward of the first step, a rear face of the pinion faces a front-most face of the housing front portion axially forward of the front-most face, an outer diameter of the front-most face of the housing portion is substantially equal to an outer diameter of the pinion; and a front face of the one-way clutch is located forward of the attachment face with respect to the axial direction.

14. A starter, comprising:

an output shaft rotatably supported and having helical splines on an outer periphery;

a pinion tube slidable in an axial direction with respect to the output shaft;

a pinion provided on a front end of the pinion tube;

a one-way clutch connecting with the output shall through the helical splines, the one-way clutch slidable on the output shaft in the axial direction and transmitting rotation of the output shaft to the pinion tube;

a stopper portion provided on the output shaft to define a maximum advanced position of the one-way clutch in the axial direction;

a bearing supporting the pinion shaft ahead of the one-way clutch in the axial direction; and a housing including an attachment face which is attached to engine side when in use, and a housing front portion formed in front of the attachment face, wherein:

the housing front portion defines an inner bore having a first cylindrical portion for enclosing the bearing at a position away from the attachment face in the axial direction, a second cylindrical portion for accommodating the one-way clutch even in the maximum advanced position to which the one-way clutch slides in the axial direction, and a third cylindrical portion axially interposed between the first cylindrical portion and the second cylindrical portion, the third cylindrical portion has an inner diameter that is smaller than an outer diameter of the one-way clutch and an axial length greater than that of the first cylindrical portion, the first and third cylindrical portions form a first step between them and the third and second cylindrical portions form a second step between them, so that an inner diameter of the inner bore decreases stepwise toward a housing front position, a rear face of the bearing is located axially forward of the first step, a rear face of the pinion faces a front-most face of the housing front portion axially forward of the front-most face, an outer diameter of the front-most face of the housing portion is substantially equal to an outer diameter of the pinion; and an axial dimension of the housing front portion is larger than outside diameter of the pinion and the axial dimension of the third cylindrical portion is greater than that of the pinion.

15. The starter as in claim 14, wherein an outside wall of the housing front portion defines a continuous conical shape from the front end to the attachment face and an outside diameter of the housing front portion gradually increases toward the attachment face.

16. A starter, comprising:

a starting motor for generating a rotation force;

an output shaft connecting to the motor for receiving the rotation force;

a pinion tube connected to the output shaft to be slidable in axial direction;

a pinion provided on a front end of the pinion tube;

a one-way clutch combined with the output shaft for transmitting rotation of the output shaft to the pinion tube and slidable on the output shaft with the pinion tube;

a stopper portion for defining a maximum advanced position of the one-way clutch in the axial direction;

a bearing provided axially forward of the one-way clutch;

a housing supporting the pinion tube through the bearing, herein the housing forms a housing front portion that defines an inner bore having a first cylindrical portion in which the bearing is held, a second cylindrical portion in which the one-way clutch is accommodated slidable in the axial direction, and a third cylindrical portion axially between the first cylindrical portion and the second cylindrical portion, and the third cylindrical portion has an inner diameter that is larger than an inner diameter of the first cylindrical portion and smaller than an inner diameter of the second cylindrical portion and an axial length that is larger than an axial length of the first cylindrical portion and an axial sliding distance of the one-way clutch.

* * * * *